United States Patent [19]

Speer

[11] Patent Number: 4,491,054

[45] Date of Patent: Jan. 1, 1985

[54] PIVOTAL PISTOL GRIP FIRING MECHANISM

[75] Inventor: Spencer J. Speer, Ontario, Calif.

[73] Assignee: General Dynamics, Pomona Division, Pomona, Calif.

[21] Appl. No.: 575,085

[22] Filed: Jan. 30, 1984

[51] Int. Cl.[3] ..... F41F 3/04

[52] U.S. Cl. ..... 89/1.814; 89/1.816

[58] Field of Search ..... 89/1.814, 1.813, 1.812, 89/1.816, 1.8; 42/75 R

[56] References Cited

U.S. PATENT DOCUMENTS

| | | | |
|---|---|---|---|
| 2,952,934 | 9/1960 | Yovanovich | 42/28 |
| 2,972,933 | 2/1961 | Guthrie | 89/1.814 |
| 3,750,529 | 8/1973 | Reed et al. | 89/1.816 X |
| 3,786,717 | 1/1974 | Vickers et al. | 89/1.814 |
| 3,999,460 | 12/1976 | Skliris | 89/1.814 X |
| 4,091,710 | 5/1978 | Lienau et al. | 89/1.816 X |
| 4,095,508 | 6/1978 | Lienau | 89/1.816 X |
| 4,164,888 | 8/1979 | Looger | 89/1.814 |
| 4,417,498 | 11/1983 | Dissmeyer et al. | 89/1.814 |
| 4,432,269 | 2/1984 | Castagner et al. | 89/1.816 |

*Primary Examiner*—David H. Brown

*Attorney, Agent, or Firm*—Neil F. Martin; John R. Lindsay; Edward B. Johnson

[57] ABSTRACT

A pivotal pistol grip firing mechanism mountable upon an operator-portable rocket launcher for use in aiming and electrically arming and firing a rocket loaded within the launcher is disclosed. A mounting bracket attached to the exterior of the launcher supports a pistol grip pivotally, between a carrying position and a firing position. The pistol grip houses a percussion activated thermal battery together with a firing pin assembly for activating the battery to supply power to fire the rocket. Energy to activate the thermal battery is not available until a firing pin spring is compressed by positioning the pistol grip in the firing position. A trigger and safety lever assembly in the pistol grip control the release of the firing pin. A manual safety switch in the pistol grip circuitry prevents transmission of the battery output unless closed by the operator prior to firing.

5 Claims, 8 Drawing Figures

PIVOTAL PISTOL GRIP FIRING MECHANISM

BACKGROUND OF THE INVENTION

The invention relates to firing mechanisms for portable rocket launchers, and particularly a pivotable pistol grip firing mechanism for use in positioning the launcher and providing for safe and controlled release of the energy of a thermal battery contained within the pistol grip to arm and fire a rocket contained within the launcher.

The availability of small folding fin stabilized rockets which can be fired by one man from a lightweight portable launcher greatly increases fire power combat effectiveness of infantry units against targets in the field. Because of their use under adverse conditions, such launchers must be safe and convenient to carry, rugged, yet quickly and accurately fired. They must also be relatively inexpensive.

Because of their size, effectiveness and adaptability, percussion activated thermal batteries are convenient to use in the firing mechanism of such launchers to provide an electrical impulse for arming the warhead and igniting the rocket motor. Due to the inherent hazards associated with a rocket motor and warhead, it is of paramount importance that the activation of the thermal battery and resultant firing of the rocket be safe from accidental activation due to rough handling, component failure, and inadvertent or improper operation by the operator.

It is desirable therefore to have a firing mechanism for man-portable rocket launchers that assists in aiming the launcher and provides safety against inadvertent or accidental activation of a rocket contained within the launcher while at the same time is readily transportable and configured to assist the operator in positioning and firing the launcher. The firing mechanism disclosed in this application meets the above requirements.

SUMMARY OF THE INVENTION

According to the invention, a firing mechanism has been devised for use with portable rocket launchers which may be compactly positioned during transport and wherein the energy to initiate firing of a rocket contained within the launcher is not present, and the firing circuit is not completed, until the firing mechanism is intentionally positioned for use.

In the exemplary embodiment, the firing mechanism is configured to be hand grippable and serve to control the position of the launcher as well as initiating the firing of a rocket from the launcher. A pistol grip is pivotably mounted in a bracket attached to the exterior of the rocket launcher to have a carrying position and a firing position. Within the pistol grip is contained a percussion activated thermal battery for supplying electrical power to arm the warhead and ignite the rocket motor to launch the self-propelled rocket from launcher tube. The thermal battery is activated by spring driven firing pin in line with the battery percussion primer element. The disclosed embodiment provides for enhance safety by use of a normally relaxed firing pin spring. The firing pin spring is compressed by a plunger which projects from the bracket mating surface of the pistol grip so that the spring is not compressed until the pistol grip is pivoted to the firing position substantially perpendicular to the launcher. A spring biased trigger assembly functions in connection with a spring biased safety lever assembly to restrain the firing pin unless the foregoing assemblies are operated simultaneously. A manually operated safety switch in the internal electrical circuitry of the pistol grip interrupts the passage of electrical power from the thermal battery to the rocket unless closed by the operator.

Provision is made in the firing mechanism mounting bracket for latching the pistol grip in either the carrying or firing position. The mounting bracket also incorporates connections for completing the electrical circuitry of the firing mechanism to a conventional wiring harness which transmits the electrical output of the firing mechanism to the arming and firing circuits contained within a rocket. It is the primary object of the invention to provide a new and improved pivotal pistol grip firing mechanism for use with portable rocket launchers. The firing mechanism disclosed provides for improved control of the launcher during aiming and firing when pivoted in its firing position, but is safely and compactly stored when in the carrying position. Increased safety is provided for by employing a design in which energy for initiation of the rocket firing sequence is not present within the firing mechanism until the pistol grip is positioned for firing and the designed operational sequence is followed. The firing mechanism is simple, rugged, and convenient to operate. It is also compact and adjustable in position on the launcher to facilitate its use in various launcher designs. The firing mechanism is relatively inexpensive and has a long shelf life.

Other objects and advantages of the invention will become apparent upon reading of the following detailed description together with the drawings in which like reference numerals refer to like parts throughout and in which.

DETAILED DESCRIPTION OF THE DRAWINGS

Figure 1:
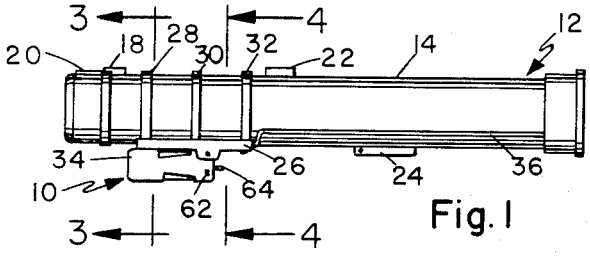
FIG. 1 is a side elevation view of a typical portable rocket launcher with the pistol grip in the carrying position.
Figure 2:
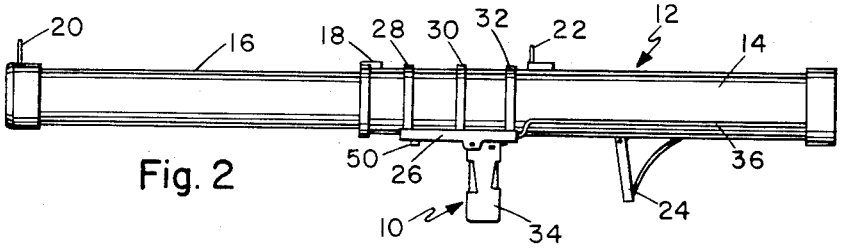
FIG. 2 is a side elevation view with the rocket launcher tube extended and the pistol grip positioned for firing.
Figure 8:
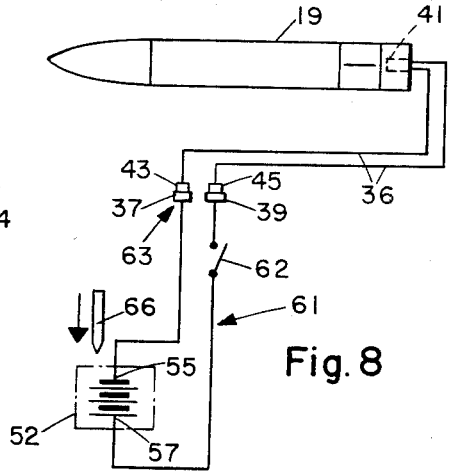
FIG. 8 is a schematic wiring diagram illustrating the pistol grip firing mechanism, launcher, and rocket firing circuitry.

The pivotal pistol grip firing mechanism 10 mounted upon a rocket launcher 12 is illustrated in FIGS. 1 and 2. The depicted launcher 12 is typical of a self-contained weapon for use by individual combat troops in the field. It incorporates an outer launch tube section 14 into which fits an inner launcher tube section 16. The inner launcher tube section 16 is extendable from the outer launch tube section 14 telescope fashion, as indicated in FIG. 2, after the release of a tube latch 18. In the field, a rocket round 19 shown schematically in FIG. 8, is loaded in the launcher 12 as a self-contained unit ready to be launched upon receipt of an electrical firing signal from the firing mechanism 10. The launcher 12 may be reloadable or expandable.

The illustrated launcher 12 is fired from the shoulder and is provided with a foldable front sight 20 and a rear side 22 for aiming. A support member 24, also foldable against the outer launcher tube 14 during transport, supports the weapon on the shoulder of the operator. The pistol grip firing assembly 10 of the present invention is readily compatible with the components of the rocket launcher 12, and is attached to the outer launch tube 14 at a position convenient for use with one hand of the operator while he steadies the extended launcher tube section 16 with the other hand. The firing mechanism 10 incorporates a mounting bracket 26 secured to the launcher tube section 14 by three fiberglass support straps 28, 30 and 32. The pistol grip 34 pivots in the mounting bracket 26 and has a carrying position when folded against the launcher tube section 14, as illustrated in FIG. 1, and firing position when pivoted substantially perpendicular to the launcher tube section 14 as illustrated on FIG. 2. The pistol grip 34 is held securely in the carrying and firing positions as will be subsequently described. A launcher wiring harness 36 electrically connects the output terminals 37 and 39 of the firing mechanism 10, illustrated in FIG. 4, with the firing circuits 41 of the rocket as depicted schematically in FIG. 8, when the pistol grip 34 is in the firing position.

Figure 3:
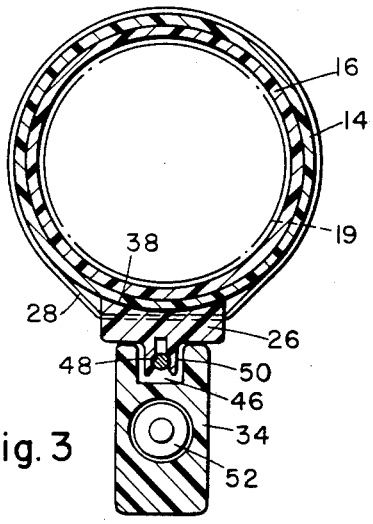
FIG. 3 is an enlarged sectional view taken on line 3—3 of FIG. 1.
Figure 4:
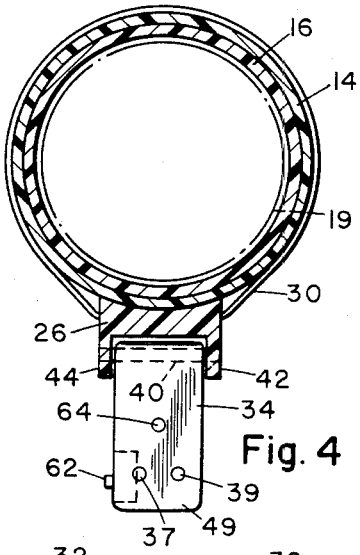
FIG. 4 is an enlarged sectional view taken on line 4—4 of FIG. 1.
Figure 5:
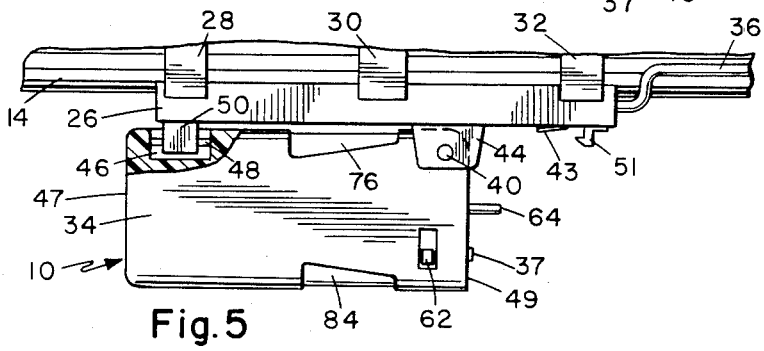
FIG. 5 is an enlarged side elevation view of the folded pistol grip in the carrying position.

Further details of the firing mechanism assembly 10 are illustrated in FIGS. 3, 4 and 5. The mounting bracket 26 is an elongated generally rectangular member having a long axis aligned with the longitudinal axis of the launcher tube section 14. A concave surface 38 of the bracket 26 conforms to the circumference of the launcher tube section 14 to facilitate holding the bracket 26 firmly in place in conjunction with the support straps 28, 30 and 32. As illustrated in FIGS. 4 and 5, the pistol grip 34 is pivotal about a pin 40 positioned in outwardly extending lugs 42 and 44 formed at the after end of the bracket 26.

As depicted in FIGS. 3 and 5, the pistol grip 34 has a recess 46 adjacent its butt end 47 as illustrated in FIG. 5. The recess 46 is bridged longitudinally by a retaining bar 48. A spring clip 50 formed in the mounting bracket 26 grips the retaining bar 48 to secure the pistol grip 34 in the carrying position. A spring biased latch 51 adjacent the bracket mating end 49 of the pistol grip 34 holds the pistol grip in the firing position as illustrated in FIG. 6.

Figure 6:
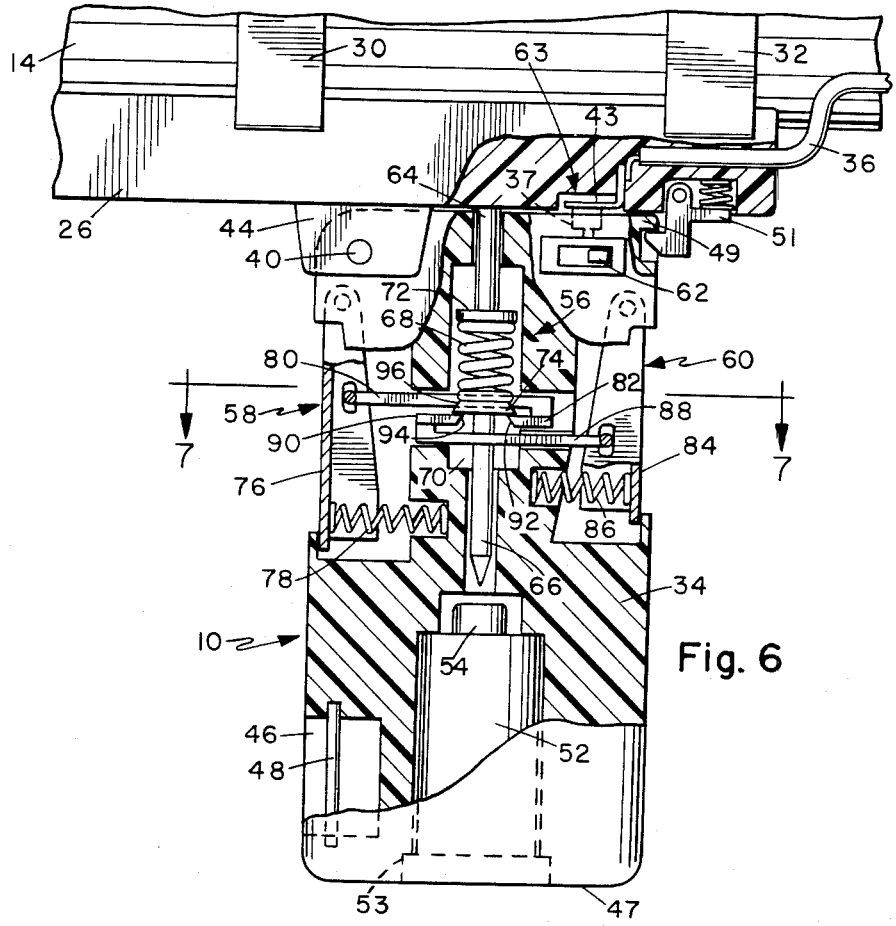
FIG. 6 is a further enlarged side elevation view of the pistol grip in the firing position, with portions cut away.

The principal internal components of the pistol grip firing mechanism 10 are further illustrated in FIG. 6. The firing mechanism is an electrical mechanical device by which the output from a thermal battery 52, activated by a percussion primer 54, is controlled by mechanical and electrical operating and safety elements to provide for safe carrying and firing of a rocket from the launcher 12. The thermal battery 52 is mounted in the pistol grip 34 adjacent the butt end 47 thereof. The battery 52 is installed through removable battery access cover 53. The other major internal elements of the firing mechanism 10 include a firing pin assembly 56, a trigger assembly 58, a mechanical safety assembly 60, and electrical circuitry 61 depicted schematically in FIG. 8. The firing mechanism circuitry includes a manually operated safety switch 62. For simplicity in the drawings, the wiring of the electrical circuit 61 is illustrated only schematically in FIG. 8. The wiring may be conveniently routed between the outputs of the thermal battery 55 and 57 and the pistol grip electrical output contacts 37 and 39.

As illustrated FIG. 6, a firing pin assembly 56 incorporates a firing pin plunger 64 and a firing pin 66 arranged in line with one another and having a firing pin spring 68 interposed therebetween. The firing pin assembly 56 is slidably supported in an elongated recess 70 in the pistol grip 34. One end of the firing spring 68 is attached to a compression disc 72 formed at the inner end of the firing plunger 64, while the opposite end of the spring 68 is attached to a firing pin cap 74 formed on the firing pin 66. The foregoing attachments made by brazing or other suitable means of attachment. In the carrying position, the spring plunger 64 projects from the pistol grip, and the firing pin spring 68 is not compressed. This design provides a principal safety feature of the firing mechanism 10 in that the energy to activate the thermal battery is not available until the pistol grip 34 is pivoted and latched in the firing position. The plunger 64 is then depressed, compressing the firing pin spring 68 against the constrained firing pin cap 74.

Figure 7:
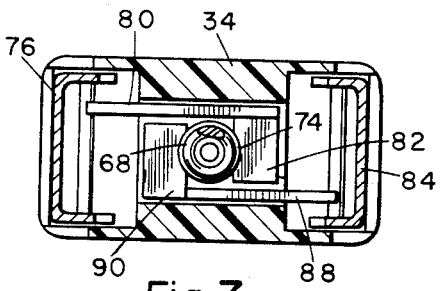
FIG. 7 is a sectional view taken on line 7—7 of FIG. 6.

The firing pin 66 is aligned to strike the thermal battery percussion primer 54, but such action is prevented when the spring 68 is compessed by the trigger assembly 58 and the mechanical safety assembly 60. The trigger assembly incorporates a pivotal trigger 76 biased to a safe position by trigger spring 78. As illustrated in FIG. 7, a trigger push rod 80 is connected at one end to the trigger 76 and at its opposite end to a trigger pawl 82. The pawl 82 engages the underside of the firing pin cap 74 preventing its downward movement unless the trigger is depressed against the bias of trigger spring 78.

The mechanical safety assembly 60 is configured in a manner similar to the trigger assembly 58. A safety lever 84 is pivotally connected in the pistol grip 34 and spaced on the opposite side of the firing pin assembly 56 from the trigger assembly 58. The safety lever 84 is biased by safety lever spring 86 to a safe position. Safety lever push rod 88 is attached to the safety lever 84 and extends inwardly past the firing pin spring 68 and is connected in a safety lever pawl 90. The pawl 90 also engages the underside of the firing pin cap 74 preventing its downward movement until the pawl is withdrawn by compression of the safety lever 84. The trigger assembly 58 and the mechanical safety assembly 60 are designed to be operated by the hand grip of the operator to release the firing pin cap 74 simultaneously, allowing the firing pin 66 to impact the battery percussion primer 54. The primer 54 activates the battery 52 to generate an electrical arming and firing signal within the firing mechanism 10. Bevelled edges 92 and 94 on the trigger pawl 82 and safety lever pawl 90 respectively cooperate with bevelled edge 96 on the firing pin cap 74 to facilitate resetting of the firing mechanism 10.

Additional important safety features are incorporated in the electrical circuit 61 of the firing mechanism 10. As illustrated at 63 in FIG. 6, and schematically in FIG. 8, the connection between the pistol grip internal circuit 61 and the harness 36 is made between contacts 37 and 39 located in the pistol grip mating surface 49 and corresponding contacts represented by 43 and 45 on the mounting bracket 26. The wiring harness 36 electrically connects the pistol grip output contacts to the arming and firing circuits of the rocket 19. When the pistol grip 34 is latched in the carrying position, the latter firing circuit connections are physically interrupted to provide additional safety isolation. An additional operator controlled safety feature located in the pistol grip 34 is a manual safety switch 62. Although the pistol grip 34 is in the firing position, the internal firing circuit 61 is open, preventing the firing of a rocket in the launcher, unless the electrical safety switch 62 is manually closed by the operator.

OPERATION

FIG. 1 depicts the launcher 12 in the carrying condition. The pistol grip 34 is pivoted and secured along the launcher tube section 14, firing pin spring 68 is not compressed, and the plunger 64 extends from the pistol grip mating surface 49. Thus, energy is not available to produce the firing action period. In addition, the circuit connection 63 between the pistol grip 34 and harness 36 is open as is the manual safety switch 62. To fire the weapon, it is put in the firing condition as illustrated in FIG. 2. The inner launch tube section 16 is extended, the front and rear sights are raised, and the shoulder support readied. The pistol grip 34 is pivoted and latched in the firing position. As illustrated in FIG. 6, by this action the firing spring plunger 64 is forced into the pistol grip 34 compressing the firing spring 68 against the restrained firing pin cap 74. The launcher 12 may then be raised to the shoulder and aimed. The pistol grip 34 facilitates such support and aiming. When the operator has a target in the sights and is otherwise ready, he closes the manual safety switch 62, and then squeezes the trigger 74 and mechanical safety lever 84 simultaneously. Such action results in the simultaneous movement of push rods 80 and 88 inwardly until the firing pin cap 74 is released by the trigger pawl 82 and mechanical safety lever pawl 90. When the cap 74 is released, the firing pin 66 is driven by the spring 68 into the percussion primer 54 causing activation of the thermal battery 52 to generate an electrical arming and firing signal. The firing signal is transmitted to the rocket arming and firing circuits 41 via the harness 36 to launch the rocket.

While the present invention has been illustrated and described by means of a particular embodiment and application, it is to be understood that changes and modifications may be made therein without departing from the spirit and scope of the invention as defined in appended claims.

Having described my invention, I claim:

1. A pivotal pistol grip firing mechanism for an operator-portable rocket launcher for use in aiming and firing a rocket loaded within the launcher, comprising:

means for mounting said firing mechanism on the launcher, pistol grip means pivotably mountable on said mounting means between a carrying position and a firing position, a thermal battery having a percussion primer for activation positionable in said pistol grip means for supplying electrical energy to fire the rocket, firing means for storing energy needed to fire said percussion primer when said pistol grip means is in the firing position, trigger means for releasing the energy stored in said firing means, mechanical safety means for preventing release of the energy stored in said firing means unless said mechanical safety means is operated simultaneously with said trigger means, means for transmitting said thermal battery electrical energy to the rocket within the launcher, safety switch means in said transmission means for preventing transmission of the electrical energy to the rocket unless closed by the operator.

2. A pivotal pistol grip firing mechanism as recited in claim 1 wherein the firing means comprises:

a plunger slidably projecting from said pistol grip means and insertable therein when said pistol grip means is in the firing position, a firing pin constrained by said trigger means and said mechanical safety means and positioned to impact said battery percussion primer, latent spring means spaced between said plunger and said firing pin for being compressed by the insertion of said plunger into said pistol grip means.

3. A pivotal pistol grip firing mechanism as recited in claim 1, wherein:

said mechanical safety means and said safety switch means are positioned adjacent to one another for one hand operation by the operator.

4. A pivotal pistol grip firing mechanism as recited in claim 1 wherein the mounting means comprises:

a bracket conformably mountable on the launcher, and strap means for securing said bracket to the launcher.

5. A pivotal pistol grip firing mechanism as recited in claim 4 wherein said bracket further comprises:

means on said bracket for selectively securing said pistol grip means in the carrying or firing position, and connection means mountable on said bracket for completing said transmission means when said pistol grip means is in the firing position.

* * * * *